US005628181A

United States Patent [19]

Kraemer

[11] Patent Number: 5,628,181

[45] Date of Patent: May 13, 1997

[54] FLASHBACK SYSTEM

[75] Inventor: Gilbert O. Kraemer, New Haven, Conn.

[73] Assignee: Precision Combustion, Inc., New Haven, Conn.

[21] Appl. No.: 485,853

[22] Filed: Jun. 7, 1995

[51] Int. Cl.[6] ..... F02G 3/00

[52] U.S. Cl. ..... 60/39.11; 60/723; 48/192; 431/346

[58] Field of Search ..... 60/39.06, 39.11, 60/737, 723, 753; 431/7, 326, 346; 48/192

[56] References Cited

U.S. PATENT DOCUMENTS

| | | | |
|---|---|---|---|
| 2,551,115 | 5/1951 | Goddard | 60/39.11 |
| 4,072,007 | 2/1978 | Sanday | 60/273 |
| 4,870,824 | 10/1989 | Young et al. | 60/723 |
| 5,026,273 | 6/1991 | Cornelison | 60/723 |
| 5,415,233 | 5/1995 | Roussakis et al. | 431/346 |

*Primary Examiner*—Charles G. Freay

*Attorney, Agent, or Firm*—Kane, Dalsimer, Sullivan, Kurucz, Levy, Eisele and Richard

[57] ABSTRACT

Flashback of flames in premixed combustion systems is avoided by passing premixed fuel and air prior to combustion through a series of two or more close coupled non-aligned multi-channel monoliths.

7 Claims, 1 Drawing Sheet

FLASHBACK SYSTEM

FIELD OF THE INVENTION

The invention relates to a nonflashback apparatus to avoid stoichiometric combustion of fuel prior to mixing with sufficient air to achieve lean mixtures for combustion.

BACKGROUND OF THE INVENTION

In conventional gas turbine combustors liquid or gaseous fuel is sprayed directly into the combustion chamber for combustion in admixture with air. Consequently, fuel-air mixing and vaporization occur in the combustion zone resulting in significant regions of stoichiometric combustion and high $NO_x$ formation.

Accordingly, to achieve lower $NO_x$ levels there has been interest in and much development of premixed/prevaporized fuel combustion systems such the dry low $NO_x$ natural gas combustors now used commercially. However, such combustors not only can have stability problems stemming from the need to operate near the lean limit but as with any premixed/prevaporized combustion system there is the potential for propagation of the flame upstream to the mixing/vaporization region with resultant stoichiometric burning and damage to the combustor. Although a safety shut-off can minimize damage, a shut down and inspection would be essential. With liquid fuels the problem is even greater. Moreover, the high combustor inlet temperatures not only of advanced stationary and aero gas turbine designs but even of most present day aero engines greatly increase the likelihood of such an occurrence. The problem is so severe that it has been questionable as to whether any premixed combustor will ever be feasible for an aero engine inasmuch as no conventional device has been deemed adequate to avoid engine damage. Not only must a device be able to block upstream flame propagation but it must impose a negligible pressure drop, i.e., less than about one percent. The present invention offers a practical low pressure drop solution to this important problem.

SUMMARY OF THE INVENTION

It has now been found that offset monoliths offer a very low pressure drop yet very effective barrier to flame propagation. In the present invention atomized fuel premixed with the combustion air is passed through an assembly of two or more monoliths prior to entering a fuel lean combustion zone. The monoliths are preferably spaced no more than five millimeters apart and at least one of the monoliths has channels of less than about two millimeters in diameter. Mounting of the monoliths with channels offset is advantageous. With monolith assemblies of the present invention, combustion does not propagate upstream of the monoliths and stoichiometric upstream combustion is avoided. In the present invention it is believed that offset monoliths are unexpectedly effective because a flame kernel passing through the center of a monolith is quenched on encountering a wall of an adjoining monolith. Downstream preignition is inhibited as a result of a reduction in turbulence after the flame arrester.

DETAILED DESCRIPTION OF THE INVENTION AND PREFERRED EMBODIMENTS

Figure 1:
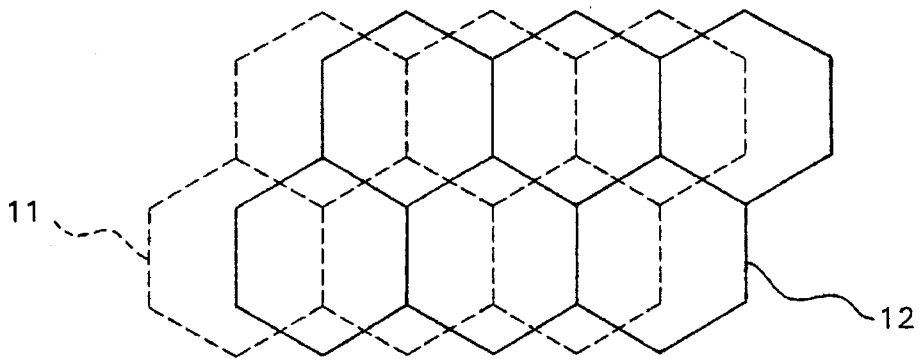
FIG. 1 shows an end view of a two element hexagonal cell monolith apparatus of the present invention showing a downstream monolith with channels offset from the channels of the upstream monolith.

As shown in FIG. 1, monoliths 11 and 12 are mounted such that the channels are not aligned. Downstream monolith 11 is mounted such that its channel walls intercept the flow from upstream monolith 12. Although both monoliths as shown have the same cell size, the downstream monolith advantageously may have larger or smaller cells to reduce pressure drop. Advantageously, at least one monolith comprises walls spaced apart less than about two millimeters, more preferably less than one millimeter.

Figure 2:
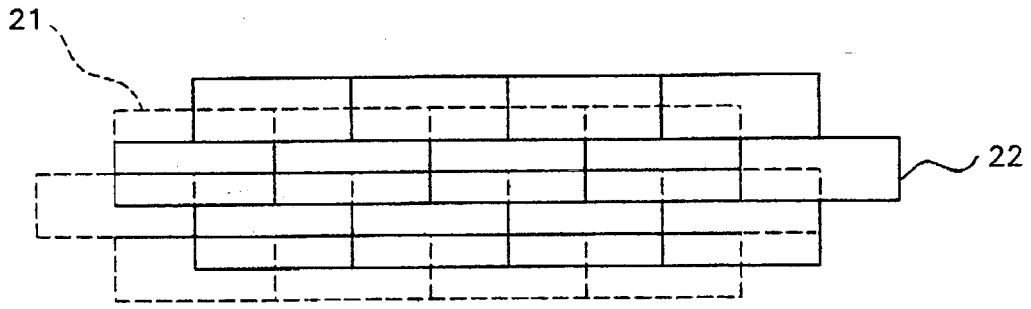
FIG. 2 shows an end view of a two element rectangular cell monolith assembly of the present invention with the downstream monolith channel walls intersecting the center channel flow from an upstream monolith.

In FIG. 2, rectangular cell monoliths 21 and 22 are similarly offset mounted. Downstream monolith 21 is mounted such that its channel walls intercept the flow from the channels of upstream monolith 22. Thus, flame propagating upstream through the downstream monolith is first partially quenched by wall contact.

Figure 3:
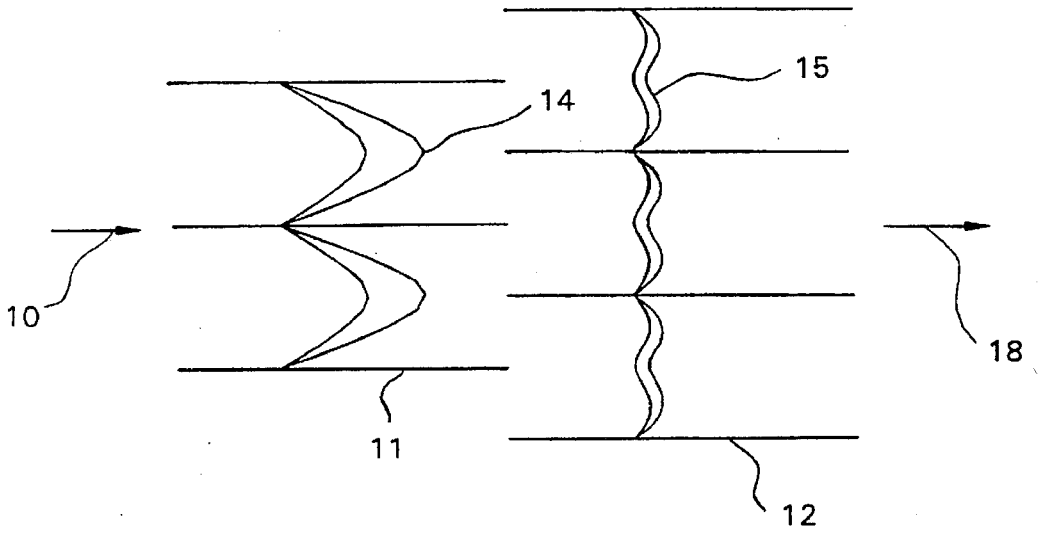
FIG. 3 shows a schematic axial cross-sectional view portraying the quenching effect of an offset upstream monolith on a flame front propagating upstream through a downstream monolith.

As shown in FIG. 3 flame kernels escaping through a monolith channel central core are intercepted and quenched by contact with the walls of the misaligned upstream monolith. In addition, as shown in FIG. 3, for maximum effectiveness the nonaligned monoliths should be close coupled to avoid flame spread between monoliths.

To test for flashback protection effectiveness, combustion was established downstream of a monolith assembly and flow velocity then decreased to below the flame flashback velocity. With only one 1.58 mm long monolith with 0.79 mm diameter cells the flame flashed back through the monolith. With three 6.35 mm long monoliths having 3.17 mm diameter cells flame also flashed back. However, with one 6.35 mm long monolith of 3.17 mm cells followed by one 1.58 mm long monolith of 0.79 mm diameter cells flashback was prevented. Thus one 0.79 mm diameter cell monolith could not prevent flashback through the monolith but with the addition of an upstream large cell monolith could.

We claim:

1. An assembly to prevent propagation of combustion, which comprises;

a multiplicity of close coupled multi-channel monoliths including at least one having walls less than about two millimeters apart;

said monoliths being arranged spatially upstream and downstream in respect to each other;

said downstream monolith being mounted such that its channel walls intercept a flow from the channels of said upstream monolith;

the channels of the upstream monolith being nonaligned with the channels of the downstream monolith.

2. The assembly of claim 1 in which at least one of said monoliths has a channel wall spacing of less than one millimeter.

3. The assembly of claim 2 in which said specified channel diameter monolith is the downstream monolith.

4. The assembly of claim 1 comprising monoliths fabricated of metal.

5. The assembly of claim 4 in which the melting point of said metal is greater than 1400 degrees Kelvin.

6. The assembly of claim 1 comprising monolith fabricated of ceramic.

7. The assembly of claim 1 wherein the upstream monolith is coupled to the downstream monolith with a space between of no more than 5 millimeters.

* * * * *